US005816873A

United States Patent [19]

Pestel

[11] Patent Number: 5,816,873

[45] Date of Patent: Oct. 6, 1998

[54] DEVICE FOR ATTACHING AN OAR TO AN INFLATABLE DINGHY

[75] Inventor: Dominique Pestel, Courbevoie, France

[73] Assignee: Zodiac International, Issy les Moulineaux, France

[21] Appl. No.: 941,965

[22] Filed: Oct. 1, 1997

[30] Foreign Application Priority Data

Oct. 4, 1996 [FR] France ..... 96 12119

[51] Int. Cl.[6] ..... B63H 16/06

[52] U.S. Cl. ..... 440/104; 114/345

[58] Field of Search ..... 440/101–110; 416/74; 114/343, 345, 347, 364

[56] References Cited

U.S. PATENT DOCUMENTS

| | | | |
|---|---|---|---|
| 206,757 | 8/1878 | Wheeler | 416/74 |
| 548,186 | 10/1895 | Forbes | 416/74 |
| 4,453,490 | 6/1984 | Miller | 440/104 |

FOREIGN PATENT DOCUMENTS

| | | |
|---|---|---|
| 0297920 | 1/1989 | European Pat. Off. . |
| 2267239 | 11/1975 | France . |
| 2365481 | 4/1978 | France . |
| 1212125 | 11/1970 | United Kingdom . |
| 2046688 | 11/1980 | United Kingdom . |

*Primary Examiner*—Ed L. Swinehart
*Attorney, Agent, or Firm*—Dean W. Russell; Kilpatrick Stockton LLP

[57] ABSTRACT

Device for attaching an oar (3) to the peripheral inflatable cushion (1) of an inflatable dinghy, characterized in that it comprises: a base (5) secured to the inflatable cushion (1) and having a retaining head (7), and a fastener (4) comprising, on the one hand, a mounting root shaped to complement the retaining head (7) so that it can be clipped removably onto this head and, on the other hand, above the said root, a ring (11) that can be deformed elastically in the radial direction and is shaped to grip tightly and elastically around the shaft (12) of an oar (3).

9 Claims, 4 Drawing Sheets

DEVICE FOR ATTACHING AN OAR TO AN INFLATABLE DINGHY

FIELD OF THE INVENTION

The present invention relates to a device for attaching an oar to the peripheral inflatable cushion of an inflatable dinghy.

SUMMARY OF THE INVENTION

The purpose of the invention is essentially to provide a device of this kind which is of a simple structure and inexpensive to manufacture, and which is easy to manipulate and can be manipulated from a distance, both for inserting and for removing the oar, it being possible for the oarsman to remain seated.

To achieve this, a device for attaching an oar to the peripheral inflatable cushion of an inflatable dinghy is essentially characterized, being arranged in accordance with the invention, in that it comprises:

- a base secured to the inflatable cushion and having a retaining head, and
- a fastener comprising, on the one hand, a mounting root shaped to complement the retaining head so that it can be clipped removably onto this head and, on the other hand, above the said root, a ring that can be deformed elastically in the radial direction and is shaped to grip tightly and elastically around the shaft of an oar.

In one embodiment, it is possible to contrive for the retaining head to be a profiled portion with a more or less Ω-shaped cross section and for the mounting root of the fastener to comprise two lower skirts facing one another and shaped to form an elastically deformable clip that can be clipped removably onto the aforementioned head with Ω-shaped section.

In a preferred embodiment, the retaining head has symmetry of revolution with an Ω-shaped cross section (mushroom shaped) and the mounting root of the fastener is shaped like a tunnel, the lower wall of which has a slot cut in it so that the tunnel-shaped root can be clipped onto the mushroom-shaped retaining head. A device for attaching an oar produced like this is extremely simple to use because the ring can be mounted permanently on the shaft of the oar and the oar can therefore be secured or released simply by sliding the oar axially, with the oar incidentally remaining engaged in its rowlock.

A device for attaching an oar produced in accordance with the invention can be fixed either to the top of the cushion or to that side thereof which faces towards the inside of the dinghy. Furthermore, because only the shaft of the oar is engaged in the ring of the attachment device, the oar can be positioned with the blade arranged in any position whatsoever, e.g. either parallel or perpendicular to the cushion.

In a practical way, the base has a mounting plate, surmounted by the said head, which is more or less flexible or semi-flexible so that it can adapt to the curvature of the cushion when secured to this cushion.

Furthermore, to make the mounting plate easier to attach to the curved surface of the cushion, provision may advantageously be made for the mounting plate to be in the form of a thin disc with a larger radial size than the head and to project beyond the latter around its periphery, so that each constituent part of the device has a flexibility or a rigidity suited to its function.

In an embodiment which is practical on account of its extreme simplicity, the ring has an approximately oval cross section, and as a preference, the mounting root of the fastener extends more or less parallel to the axis of the ring.

The attachment device in accordance with the invention is made of parts with simple shapes which can be manufactured economically from moulded plastic. A device of this kind will therefore be suitable for equipping widely available bottom-of-the-range inflatable dinghies.

BRIEF DESCRIPTION OF THE DRAWINGS

The invention will be better understood from reading the detailed description which follows of a number of embodiments of the device of the invention, which are given solely by way of non-limiting examples. In this description, reference is made to the appended drawings in which.

DETAINED DESCRIPTION

Figure 1:
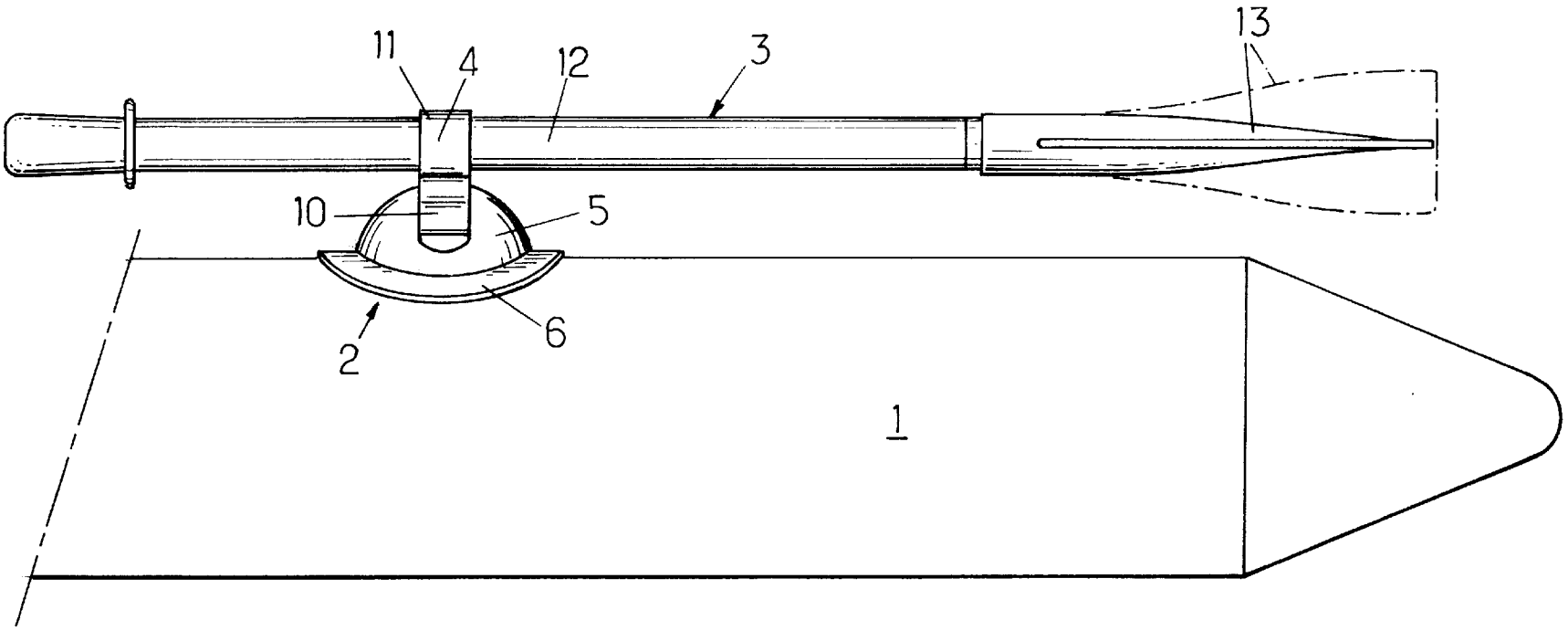
FIG. 1 is a partial side view of an inflatable cushion of an inflatable dinghy equipped with an oar attachment device in accordance with the invention.

Depicted diagrammatically in FIG. 1 is part (the rear part) of a peripheral inflatable cushion 1 of an inflatable dinghy which is equipped with an attachment device 2 capable of supporting an oar 3 arranged more or less parallel to the cushion 1. FIG. 1 is assumed to be a view from the side, the oar 3 extending above the cushion 1, but it could just as easily be a view from above, the oar 3 then being supported on that side of the cushion that faces towards the inside of the dinghy.

Figure 2:
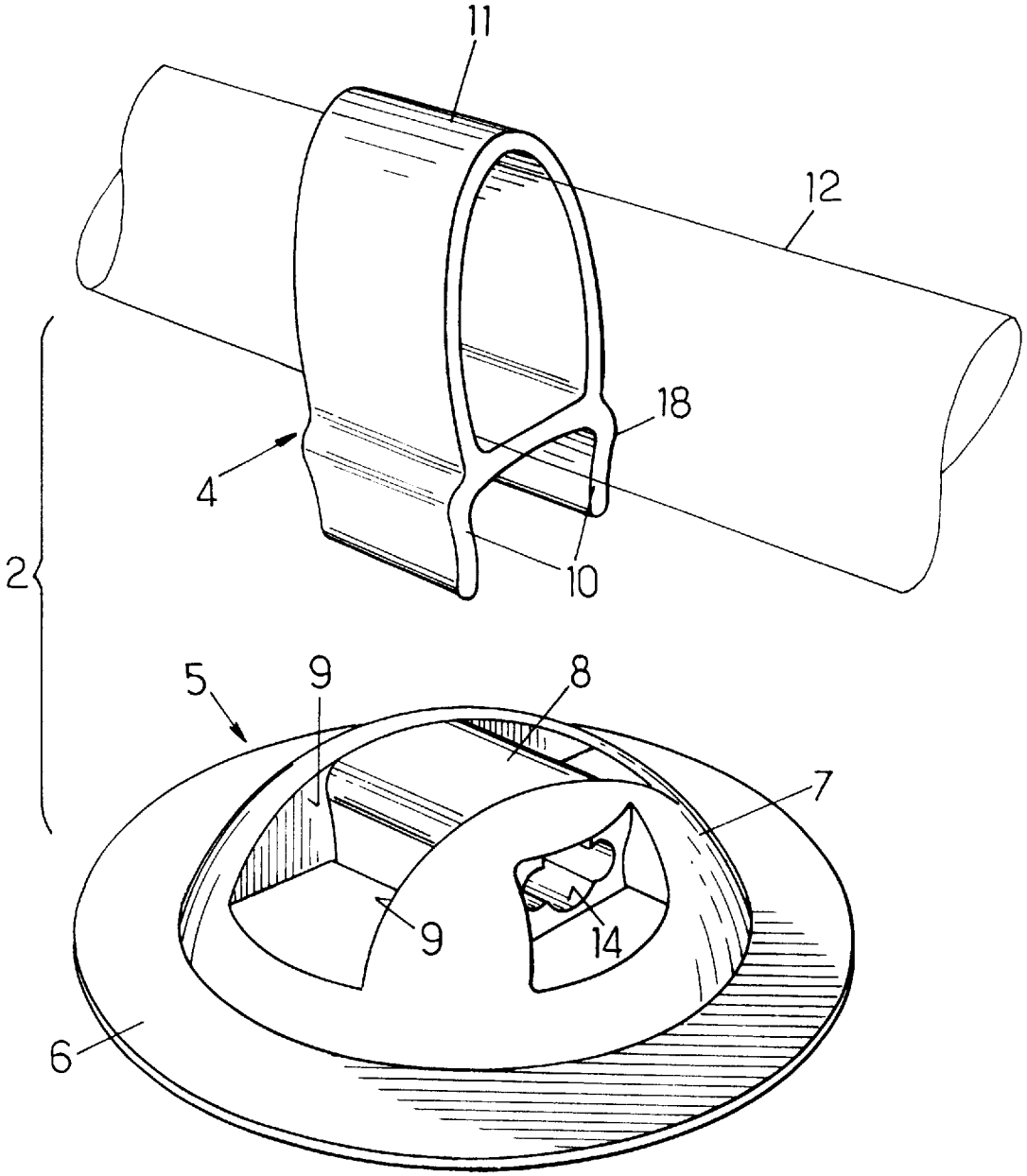
FIG. 2 is an exploded perspective view illustrating the two main parts forming a first embodiment of the device of the invention.

As seen more clearly in FIG. 2, the attachment device 2 is essentially composed of two parts, namely a base 5 and a removable fastener 4.

Although it could be produced as a single piece, the base 5 is, however, preferably made of two parts joined together (for example by welding or by bonding): a mounting plate 6 is in the form of a thin disc, for example made of a flexible or semi-flexible plastic, capable of adapting to the curvature of the cushion 1 to which it is secured, e.g. by bonding; and surmounting the mounting plate 6, a retaining head 7 which in this embodiment consists, at least in part, of a profiled portion with a more or less Ω-shaped cross section.

In the embodiment depicted in FIGS. 1 and 2, the head 7 has a hemispherical or equivalent overall shape, in which two diametrically opposed recesses give access to the Ω-shaped central part 8. The two part-spherical parts situated at the respective ends of the Ω-shaped central part form two axial stops 9 for the removable fastener 5 clipped over the Ω-shaped part as explained below.

The fastener 4 comprises, on the one hand, a mounting root 18 shaped to complement the retaining head 7 so that it can be clipped removably onto the latter.

In the embodiment more specifically envisaged in FIGS. 1 and 2, the mounting root comprises two lower skirts 10 projecting downwards and facing one another and shaped to form an elastically deformable clip which can be clipped removably over the Ω-shaped part 8 of the attachment head.

Furthermore, the fastener 4 comprises, above the aforementioned mounting root, a ring-shaped part 11 which is elastically deformable in the radial direction, and two opposed regions of which are separated, in the non-deformed state, by a distance which is appreciably smaller than the transverse dimension of the shaft 12 of the oar. In other words, the ring 11 is not cylindrical of revolution but is more or less flattened, for example approximately oval, in a direction which is more or less transverse with respect to the skirts 10. This means that the shaft 12 of the oar 3, inserted into the ring 11, radially expands this ring and is trapped therein by pinching. Furthermore, to make this device simple to use, it is desirable for the mounting root of the fastener to extend more or less parallel to the axis of the ring.

Another result of this is that there is no predefined position for mounting the oar in the ring 11 and that if the ring 11 is positioned high enough above the cushion 1, the oar can just as easily be arranged with its blade 13 positioned flat, parallel to the cushion (in solid line in FIG. 1) as it can transversely to the cushion (in dashed line in FIG. 1).

The mounting plate 6 may very advantageously have larger dimensions than the attachment head 7 and project radially beyond the latter around the periphery. The attachment head 7 may be made of rigid plastic, as may the fastener 4.

The attachment head 7 may preferably have an internal passage 14 cut in it, this passage extending beneath the Ω-shaped section and in the axial direction of the latter and opening at the end faces of the head. This head thus becomes easier to manufacture by moulding, and can then have a line of some kind passing through it and have the additional function of acting as a mooring stud or attachment stud of any kind.

Figure 3:
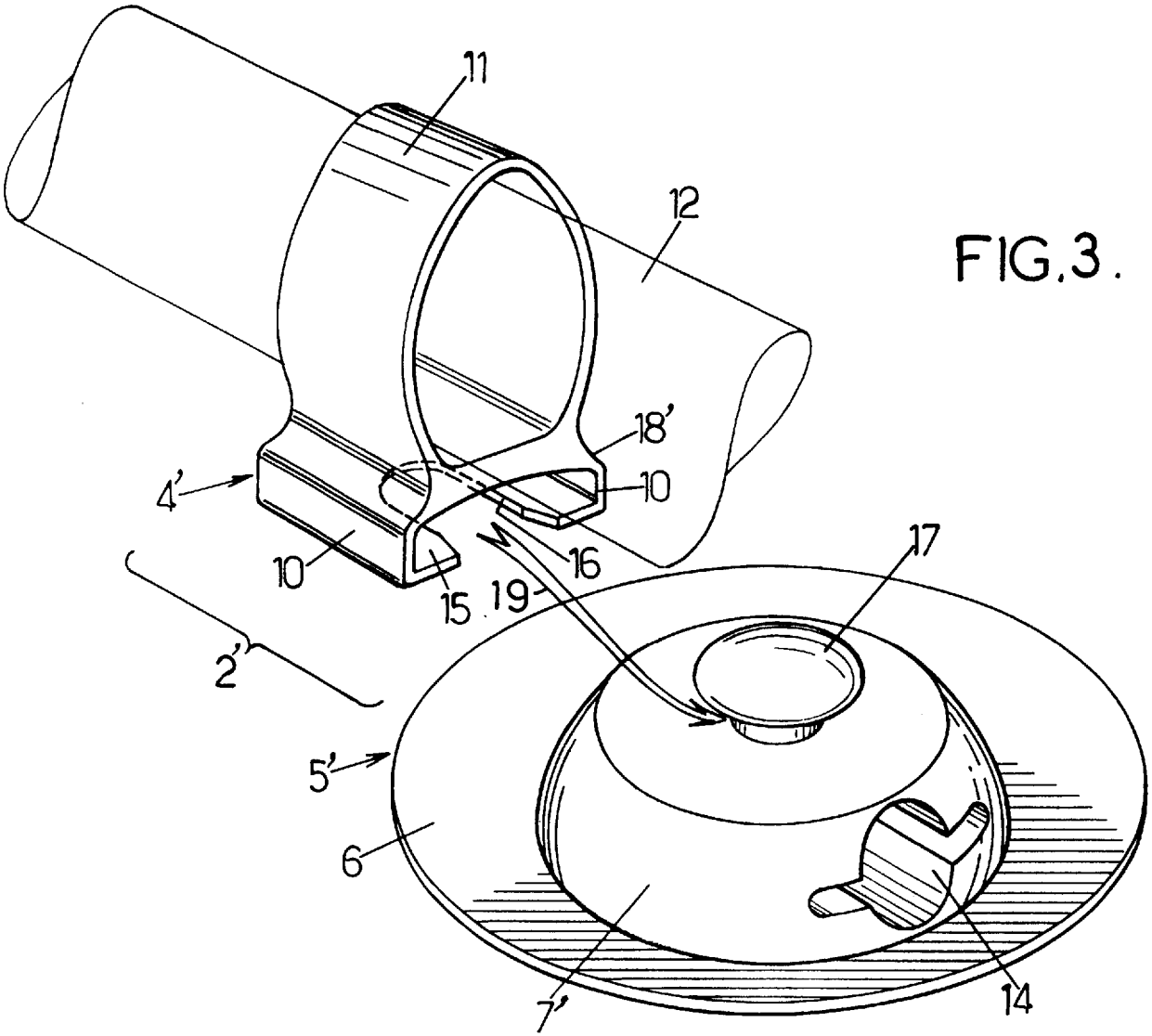
FIG. 3 is an exploded perspective view of a second, preferred, embodiment of the device of the invention.
Figure 4:
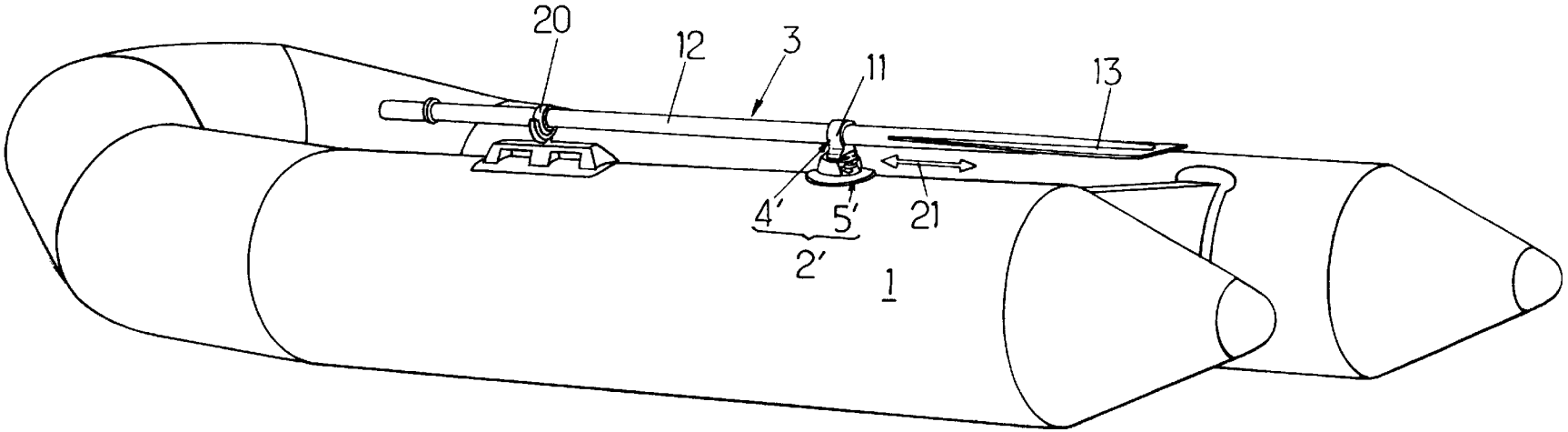
FIG. 4 is a partial perspective view of an inflatable dinghy equipped with the device of FIG. 3.

Depicted in FIGS. 3 and 4 to which reference is now made is a preferred embodiment of the device of the invention which, although differing little in its structure from the embodiment shown in FIGS. 1 and 2, nonetheless has the very attractive advantage of being significantly easier to use. In FIGS. 3 and 4, the same numerical references have been kept to denote members which are identical to those of FIGS. 1 and 2, sometimes followed by a “'”if the member has the same function but has been modified. As can be seen in FIG. 3, in the fastener 4', the two skirts 10 are joined together at their lower end by a bottom plate 15 which has an axial slot 16 cut in it (parallel to the axis of the ring 11) and extending more or less halfway along the component. The assembly is therefore in the approximate shape of a hollow runner or 25 tunnel denoted overall by 18'.

As far as the base 5' is concerned, its retaining head 7' has symmetry of revolution with a broadened part upper (with a transverse dimension that exceeds the 30 width of the aforementioned slot 16) surmounting a narrow body (with a transverse dimension at most equal to the width of the aforementioned slot 16).

The fastener 4' is then fitted onto the base 5' very simply, by sliding the former over the latter as indicated by the arrow 19 so that the tunnel-shaped root 18' clips over the mushroom-shaped retaining head 17. An arrangement of this kind is particularly advantageous to the user because, as is clearly visible in FIG. 4, all he needs to do is to move the oar 3 (which incidentally remains permanently engaged in the rowlock 20) longitudinally (that is to say more or less parallel to the axis of the cushion 1 of the dinghy), this movement being shown diagrammatically by the double-headed arrow 21, in order to engage the fastener 4' on the base 5' or disengage it therefrom, it being possible for the fastener 4' to remain permanently locked on the shaft 12 of the oar 3.

As goes without saying, and as is already obvious from the foregoing, the invention is not in any way limited to those of its applications and embodiments which have been more particularly envisaged; on the contrary, it encompasses all alternative forms thereof.

I claim:

1. An inflatable boat having a peripheral inflatable cushion and a device for attaching an oar having a shaft to the peripheral inflatable cushion, the device comprising:

a base secured to the inflatable cushion and having a retaining head, and a fastener comprising a mounting root shaped to complement the retaining head so that it can be clipped removably onto the retaining head and, above the root, a ring that can be deformed elastically in the radial direction and is shaped to grip tightly and elastically around the shaft of the oar.

2. An inflatable boat according to claim 1 in which the retaining head is a profiled portion with a generally Ω-shaped cross section and in which the mounting root of the fastener comprises two lower skirts facing one another and shaped to form an elastically deformable clip that can be clipped removably onto the retaining head.

3. An inflatable boat according to claim 1 in which the retaining head has symmetry of revolution with a broadened upper part and in which the mounting root of the fastener has a the lower wall defining a slot for clipping onto the broadened upper part of the retaining head.

4. An inflatable boat according to claim 1 in which the base has a mounting plate , surmounted by the retaining head, which is generally at least semi-flexible so that it can adapt to the curvature of the cushion when secured to this cushion.

5. An inflatable boat according to claim 4 in which the mounting plate is in the form of a thin disc with a larger radial size than the retaining head and projects beyond the latter around its periphery.

6. An inflatable boat according to claim 1 in which the ring has an approximately oval cross section.

7. An inflatable boat according to claim 1 in which the mounting root of the fastener extends generally parallel to the axis of the ring.

8. An inflatable boat according to claim 1 in which the retaining head has a through passage which can act as a means of attachment for a mooring line.

9. A device for attaching an oar having a shaft to a peripheral inflatable cushion of an inflatable boat, the device comprising:

a. a base adapted to be secured to the inflatable cushion in use and having a retaining head, and b. a fastener comprising a mounting root shaped to complement the retaining head so that it can be clipped removably onto the retaining head and, above the root, a ring that can be deformed elastically in the radial direction and is shaped to grip tightly and elastically around the shaft of the oar.

* * * * *

UNITED STATES PATENT AND TRADEMARK OFFICE

CERTIFICATE OF CORRECTION

PATENT NO. : 5,816,873
DATED : October 6, 1998
INVENTOR(S) : Dominique Pestel

It is certified that error appears in the above-indentified patent and that said Letters Patent is hereby corrected as shown below:

column 1, line 7, after "inflatable" insert --boat such as a-- column 2, line 27, delete "DETAINED" and insert --DETAILED-- column 3, line 48, delete "25"

column 3, line 50, delete "part upper" and insert --upper part 17-- column 3, line 51, delete "30"

Signed and Sealed this

Eleventh Day of January, 2000

*Attest:*

Q. TODD DICKINSON

*Attesting Officer*

*Acting Commissioner of Patents and Trademarks*